US010123135B2

(12) United States Patent
Rosenkranz et al.

(10) Patent No.: US 10,123,135 B2
(45) Date of Patent: Nov. 6, 2018

(54) METHOD AND HEARING DEVICE FOR TRANSMITTING AN AUDIO SIGNAL FROM A TRANSMITTER TO A RECEIVER

(71) Applicant: SIVANTOS PTE. LTD., Singapore (SG)

(72) Inventors: Tobias Daniel Rosenkranz, Erlangen (DE); Henning Puder, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/487,474

(22) Filed: Apr. 14, 2017

(65) Prior Publication Data

US 2017/0303054 A1 Oct. 19, 2017

(30) Foreign Application Priority Data

Apr. 14, 2016 (DE) ..... 10 2016 206 327

(51) Int. Cl.

| | |
|---|---|
| ***H04R 25/00*** | (2006.01) |
| ***G10L 21/038*** | (2013.01) |
| ***G10L 19/038*** | (2013.01) |
| ***G10L 19/04*** | (2013.01) |

(52) U.S. Cl.

CPC ..... *H04R 25/554* (2013.01); *G10L 19/038* (2013.01); *G10L 19/04* (2013.01); *G10L 21/038* (2013.01); *H04R 25/552* (2013.01); *H04R 2225/51* (2013.01)

(58) Field of Classification Search

CPC ..... H04R 25/554; H04R 25/552; H04R 2225/51; G10L 19/038; G10L 19/04; G10L 21/038

USPC ..... 381/315

See application file for complete search history.

(56) References Cited

U.S. PATENT DOCUMENTS

| | | | | |
|---|---|---|---|---|
| 2004/0044527 | A1* | 3/2004 | Thumpudi | G10L 19/008 704/230 |
| 2010/0014679 | A1 | 1/2010 | Kim et al. | |
| 2011/0046966 | A1* | 2/2011 | Dalimba | G10L 19/035 704/503 |

* cited by examiner

*Primary Examiner* — Sunita Joshi

(74) *Attorney, Agent, or Firm* — Laurence A. Greenberg; Werner H. Stemer; Ralph E. Locher

(57) ABSTRACT

A method transmits an audio signal from a transmitter to a receiver and a hearing device, particularly a hearing aid, contains a communication facility which is provided and configured for transmitting and/or receiving an audio signal according to the method. A hearing device system has two hearing devices and is provided and configured to transmit audio signals between the two hearing devices by their communication facilities according to the method.

13 Claims, 3 Drawing Sheets

METHOD AND HEARING DEVICE FOR TRANSMITTING AN AUDIO SIGNAL FROM A TRANSMITTER TO A RECEIVER

CROSS-REFERENCE TO RELATED APPLICATION

This application claims the priority, under 35 U.S.C. § 119, of German application DE 10 2016 206 327.8, filed Apr. 14, 2016; the prior application is herewith incorporated by reference in its entirety.

BACKGROUND OF THE INVENTION

Field of the Invention

The invention relates to a method for transmitting an audio signal from a transmitter to a receiver. The invention also relates to a hearing device and to a hearing device system having two such hearing devices. The hearing device is preferably a hearing aid.

Persons who suffer from a reduction in their hearing power normally use a hearing aid. In this context, environmental sound is detected in most cases by an electromechanical sound transducer. The detected electrical signals are processed by an amplifier circuit and introduced into the auditory canal of the person by a further electromechanical transducer. Different types of hearing aids are known. The so-called "behind-the-ear" devices are worn between head and outer ear. The amplified sound signal is here introduced into the auditory canal by an acoustic tube. A further commonly used embodiment of a hearing aid is an "in-the-ear device" in which the hearing aid itself is introduced into the auditory canal. In consequence, the auditory canal is closed by the hearing aid, at least partially, so that apart from the sound signals generated by the hearing aid, no further sound—or only sound reduced to a great extent—can penetrate into the auditory canal.

If the person suffers from an impairment of the hearing power of both ears, a hearing device system having two such hearing aids is utilized. In this context, one of the hearing aids is in each case allocated to each of the ears. To provide the person with spatial hearing, it is required that the audio signals acquired with one of the hearing aids are in each case provided to the respective other hearing aid. This requires, on the one hand, transmission with only a comparatively small time offset. On the other hand, the head of the person acts as attenuation which is why the transmission rate between the hearing aids is limited. In addition, transmitting power is limited because of the limited energy store of the hearing aids and the loading on the person which is otherwise too great.

SUMMARY OF THE INVENTION

The invention is based on the object of specifying a particularly suitable method for transmitting an audio signal from a transmitter to a receiver and a particularly suitable hearing device and a particularly suitable hearing device system having two hearing devices, an audio quality being improved, in particular, and a transmission rate being preferably reduced.

The method is used for transmitting an audio signal from a transmitter to a receiver, the transmitter or the receiver preferably being a component of a hearing device. The respective remaining element, that is to say the transmitter or the receiver, respectively, is suitably a component of a further structural part of a hearing device system having the hearing device.

For example, the hearing device is a headset or contains a headset. Particularly preferably, however, the hearing device is a hearing aid. The hearing aid is used for supporting a person suffering from a reduction of their hearing power. In other words, the hearing aid is a medical device by which, for example, a partial loss of hearing is compensated for. The hearing aid is, for example, a "receiver-in-the-canal" (RIC) hearing aid, an in-ear hearing aid, such as an "in-the-ear" hearing aid, an "in-the-canal" (ITC) hearing aid or a "complete-in-canal" (CIC) hearing aid, hearing aid glasses, a pocket hearing aid, a bone conduction hearing aid or an implant. Particularly preferably, the hearing aid is a "behind-the-ear" hearing aid which is worn behind the outer ear.

The method provides that at the transmitter end, an input signal corresponding to the audio signal is subdivided in time into time windows, the length of the time windows preferably being equal. The length of the time windows is, for example, between 0.5 ms and 2 ms and particularly equal to 1 ms. The input signal is preferably the audio signal or a part thereof. For example, the audio signal is split into different input signals, each input signal being subdivided in each case into different time windows which differ, in particular, by their length. For a particular time window, the input signal is divided at the transmitter end into a number of frequency channels. At the transmitter end, a current channel value is allocated to each frequency channel. The channel value is, for example, an amplitude and/or a phase or a signal level. At the transmitter end, the current channel values are divided into a first current data record and a second current data record, the first current data record and the second current data record in each case containing at least one of the current channel values. In particular, the first current data record only has a single one of the current channel values.

By means of at least one channel value preceding in time, a first forecast is generated for the first current data record at the transmitter end. In particular, the generation is such that a difference (prediction error) between the first current data record and the first forecast is as small as possible. The first forecast suitably contains the same number of values as the first current data record. For example, the first forecast only has a single value. The channel value preceding in time has been allocated, for example, to one of the frequency channels one time window earlier in time, for example to the same frequency channel for which the forecast is generated, particularly if the first current data record only contains a single one of the current channel values. Preferably, a number of channel values preceding in time is utilized, for example channel values of other frequency channels and/or channel values having a varying distance in time being used.

At the transmitter end, a first deviation between the first forecast and the first current data record is determined, that is to say by how much the first forecast and the first current data record differ. Furthermore, a second forecast is generated for the second current data record at the transmitter end by the first current data record. In this context, the first current data record and/or the first deviation are utilized directly, for example. The second forecast contains suitably the same number of values as the second current data record, the second forecast, in particular, being generated in such a manner that a difference between the second current data record and the second forecast is as small as possible. At the transmitter end, a second deviation between the second forecast and the second current data record is determined, that is to say by how much the second forecast and the second current data record differ.

A first transmission value corresponding to the first deviation is transmitted from the transmitter to the receiver, the first transmission value suitably being generated initially at the transmitter end by the first deviation. The first transmission value preferably has a lesser dimensionality or, at the most, the same dimensionality as the first deviation and is, for example, a one-dimensional value. A second transmission value corresponding to the second deviation is transmitted from the transmitter to the receiver, the second transmission value suitably being generated initially at the transmitter end by the second deviation. The second transmission value preferably has a lesser dimensionality or, at the most, the same dimensionality as the second deviation and is, for example, a multi-dimensional or particularly preferably a one-dimensional value. The dimensionality of the first and of the second transmission value is preferably identical.

In a further operating step, a first reconstructed data record is generated at the receiver end by a reconstructed output signal preceding in time and the transmitted first transmission value. As the reconstructed output signal preceding in time, a value or a data record is suitably utilized which corresponds to the channel value preceding in time, existing at the transmitter end. For example, zero (0) is utilized at the beginning of the method as the channel value preceding in time or as reconstructed output signal preceding in time or a particular value is initially transmitted from the transmitter to the receiver and utilized both at the transmitter-end and also receiver-end as channel value preceding in time or as reconstructed output signal preceding in time. The first reconstructed data record generated in this way thus corresponds essentially to the first data record present at the transmitter end, differences being present preferably only due to the generation of the first transmission value.

In a further operating step, a second reconstructed data record is generated at the receiver end by means of the first reconstructed data record and the transmitted second transmission value. For the generation, other data present at the receiver end are additionally used, in particular. The second reconstructed data record generated in this way essentially corresponds here to the second data record present at the transmitter end, differences preferably existing only due to the generation of the second transmission value and/or due to differences between the first reconstructed data record and the first data record.

The first reconstructed data record and the second reconstructed data record are combined at the receiver end to form a reconstructed output signal. In this context, the combination is especially the inverse function to the transmitter-end division of the current channel values into the first current data record and the second current data record so that, at the receiver end, the division present at the transmitter end of the input signal into the frequency channels is present. The reconstructed output signal essentially corresponds to the division of the input signal, present at the transmitter end, into the frequency channels. For example, the reconstructed output signal is processed further at the receiver end and the individual frequencies are combined and transferred into the time domain. For example, when the method is carried out again, the reconstructed output signal is utilized and used as the reconstructed output signal preceding in time. The method is preferably carried out again after the particular time window has elapsed.

The first transmission value is preferably generated as soon as the first deviation is generated, and is transmitted directly following this to the receiver, particularly before or at least simultaneously before generation of the second forecast. In particular, the second forecast/the second deviation and the first reconstructed data record are essentially generated at the same time so that simultaneous processing takes place at the transmitter and receiver end as a result of which a rate of transmission is increased.

Suitably, the second forecast is also generated at the transmitter end by means of the channel value preceding in time and the second reconstructed data record is also generated at the receiver end by means of the reconstructed output signal preceding in time, a number of reconstructed output signals preceding in time or channel values preceding in time being used, for example. In this way, the second deviation is reduced.

For generating the first forecast and the first reconstructed data record, a linear prediction is preferably utilized. Alternatively or in combination therewith, a linear prediction is utilized for generating the second forecast and the second reconstructed data record. In other words, each value is generated by a linear combination, a number of channel values preceding in time, a number of reconstructed output signals preceding in time, a number of first current data records and, respectively, a number of first reconstructed data records preferably being utilized.

In summary, the values of the first forecast, of the first reconstructed data record, of the second forecast and of the second reconstructed data record are determined by the formula $$\hat{x}(n) = \sum_{i=1}^{N} a_i y(n-i)$$

or $$\hat{x}(n) = \sum_{i=1}^{N} A y(n-i).$$

where $\hat{x}(n)$ designates the first forecast, the first reconstructed data record, the second forecast and the second reconstructed data record, respectively, $a_i$ designates a coefficient, A a coefficient matrix and y the totality of the values which are utilized for the generation, particularly the channel values preceding in time, the reconstructed output signals preceding in time, the first current data records and the first reconstructed data records, respectively, wherein, in particular, a number of such values are utilized, the respective time of generation of which differs. In this context, the generation time is n–i, and the number used is N. A type of linear prediction is disclosed, for example, in "Benesty, J., Chen, J. & Huang, Y. (Arden) (2008), Linear Prediction. In J. Benesty, M. M. Sondhi, & Y. (Arden) Huang (editors), Springer Handbook of Speech Processing (pp. 111-125), Springer Verlag", especially in chapter 7.2 (page 112 -113), particularly formula 7.6 and especially in chapter 7.9 (page 120 -124), particularly formula 7.108.

For example, the input signal is divided into the frequency channels by means of a Fourier transform. Particularly preferably, however, channel-pass filters are utilized which are preferably combined to form a filter bank. For example, the first transmission value is generated by quantization of the first deviation and/or the second transmission value is generated by quantization of the second deviation. In this context, the first transmission value which can suitably assume only a discrete number of different values, is allocated to the first deviation. The second transmission value which can suitably assume only a discrete number of different values is allocated to the second deviation, wherein the number is, for example, different or equal to the number of possible values of the first transmission value. In other words, the first and second transmission value, respectively, is a discrete value.

Preferably, a third reconstructed data record is generated at the transmitter end by the first transmission value and/or the second transmission value and by means of the first forecast and of the second forecast, respectively. The third reconstructed data record corresponds to the reconstructed output signal, but is present at the transmitter. In other words, the output signal is reconstructed at the transmitter end also by the first transmission value and of the second transmission value, respectively, but it can differ slightly from the input signal due to the quantization and the resultant introduced noise. The third reconstructed data record is utilized as channel value preceding in time. At least, one of the values of the third reconstructed data record or all values are utilized for this purpose. In this way, deviations between the output signal and the input signal, due to the quantization, are taken into consideration in the generation of the first/second forecast which is why a maximum deviation between the input signal and the reconstructed output signal remains slight even with a repeated execution of the method, and thus a high quality exists during the transmitting of the audio signal. In particular, the advantage of this method is that only information/signals are used which are present both at the transmitter end and at the receiving end. Thus, the reconstructed signals in the transmitter and receiver are identical (at least with faultless transmission).

For the quantization of the first deviation the same quantization is suitably used as for the quantization of the second deviation. For example, a scalar quantization is utilized. Particularly preferably, the quantization is a vector quantization. Suitably, a so-called gain-shape vector quantization is utilized. The quantized signal is here divided into the signal shape/vector shape and a scaling factor (gain). A particularly suitable form of the gain-shape vector quantization is represented by the logarithmic vector quantization, particularly the (spherical-) logarithmic vector quantization. In this context, possible signal shapes/vector shapes are points on a (potentially) highly dimensional unity sphere (i.e. having radius 1). The scaling factor is here logarithmically quantized, for example using the familiar A law. Signal shapes/vector shapes to be considered are also other shapes such as, for example (highly dimensional) pyramids or cubes. A spherical-logarithmic vector quantization is known, for example, from "B. Matschkal and J. B. Huber, "Spherical logarithmic quantization", IEEE Trans. Audio, Speech and Language Processing, vol. 18, pp. 126-140, January 2010", especially from chapter III, an example having been disclosed in chapter IV, especially in FIGS. 8 and 9.

The first reconstructed data record is preferably generated in that, by means of the first transmission value, a first auxiliary data record is generated which corresponds to the first deviation. In other words, an application of the same generation rule by means of which the first transmission value is generated, to the first auxiliary data record, would result in the first transmission value. In particular, a biunique function is utilized for generating the first transmission value, and the inverse function thereof is used for generating the first auxiliary data record by means of the first transmission value. Furthermore, a first auxiliary forecast, which corresponds to the first forecast and preferably conforms to it is generated by means of the reconstructed output signal preceding in time. Preferably, the same calculating rule is utilized for generating the first auxiliary forecast by means of the reconstructed output signal proceeding in time, as for generating the first forecast by means of the channel value preceding in time. Suitably, the reconstructed output signal preceding in time is also divided into channels which correspond to the frequency channels. The first auxiliary data record is added to the first auxiliary forecast. The addition is suitably carried out value by value. In other words, respective corresponding values of the two data records are added together and the sum forms in each case a value of the first reconstructed data record. In summary, each value of the first auxiliary data record is added to a value of the first auxiliary forecast. In particular, the first reconstructed data record corresponds to the first current data record. In other words, all values of the two data records are essentially identical.

The second reconstructed data record is preferably generated in that, by means of the second transmission value, a second auxiliary data record is generated which corresponds to the second deviation. In other words, an application of the same generation rule by which the second transmission value is generated, to the second auxiliary data record would result in the second transmission value. In particular, a biunique function is utilized for generating the second transmission value, and the inverse function thereof is used for generating the second auxiliary data record by means of the second transmission value. Furthermore, a second auxiliary forecast which corresponds to the second forecast and preferably conforms to it is generated by means of the first reconstructed data record. Preferably, for generating the second auxiliary forecast by means of the first reconstructed data record, the same calculating rule is preferably utilized as is used for generating the second forecast by means of the first data record. The second auxiliary data record is added to the second auxiliary forecast. The addition suitably occurs value by value. In other words, corresponding values of the two data records are in each case added together and this sum in each case forms a value of the second reconstructed data record. In summary, each value of the second auxiliary data record is added to a value of the second auxiliary forecast. In particular, the second reconstructed data record corresponds to the second current data record. In other words, all values of the two data records are essentially equal.

If the third reconstructed data record is used, both the first and the second auxiliary data record is preferably generated at the transmitter end and in each case added to the values of the first and second forecast, respectively. If, in consequence, a noise is introduced into the first and second transmission value, respectively, due to the quantization, this is taken into consideration during another determination of the first and second forecast and auxiliary forecast, respectively, both at the transmitter end and at the receiver end.

Preferably, the first and/or second deviation is generated in that the difference between each current channel value of the first current data record and of the second current data record, respectively, and an allocated prognostic value of the first and second forecast is generated for forming a difference value. In other words, each current channel value of the respective current data record is subtracted from a corresponding prognostic value of the respective forecast or, respectively, each prognostic value of the respective forecast is subtracted from the corresponding current channel value of the respective current data record. The difference values generated during this process form the first and second deviation, respectively. In other words, the first/second deviation is a data record/vector and the number of difference values of the first deviation is equal to the number of the current channel values of the first current data record which is equal to the number of prognostic values of the first forecast. The number of difference values of the second deviation is also equal to the number of the current channel value of the second current data record and equal to the number of prognostic values of the second forecast. The individual prognostic values of the first forecast are generated especially independently from one another and the prognostic values are preferably at least partially generated in parallel in time. Alternatively or especially preferably in combination therewith, the generation of the individual prognostic values of the second forecast takes place especially independently of one another and the prognostic values are preferably generated at least partially in parallel in time.

For example, the current channel values are essentially divided in halves between the first current data record and the second current data record so that the first current data record, in consequence, essentially has the same number of channel values as the second current data record, the numbers differing by one (1), for example. In this context, in particular, an index is allocated to each frequency channel, all frequency channels having an even index suitably being allocated to one of the current data records and the frequency channels having an odd index being allocated to the remaining current data record. For example, all frequency channels having an odd index are allocated to the first current data record. Due to the procedure, the first reconstructed data record and the second reconstructed data record especially essentially also have the same number of reconstructed channel values.

In summary, the input signal, in particular, is fed into a number N of frequency channels. This produces a signal which depends both on the time and on the frequency channel. The signal thus represents the current channel values and the channel values preceding in time. The signal can be designated by x(t,k), where t designates the (discrete) time index and k the channel index. The totality of current channel values is consequently x(t1,k), the time index t1 designating the current time/the current time window. Each x(t,k) is generally a complex number. For a compact mathematical representation of the method, x(t,k<1)=0, for example. Similarly, x(t,k>N+1) should be =0.

The first and second forecast, respectively, are generated in particular by means of the formula, where the current time/the current time window is designated by t, $$\tilde{x}(t,k) = \sum_{m=M}^{M^+} \sum_{i=1}^{l_m} a_{i,m}^k \cdot \tilde{x}(t-i, k-m) + \sum_{l=1}^{L} a_l^k \cdot \tilde{x}(t, k-l)$$

$$M^+ \geq 0,\ M^- \leq 0,\ l_m \geq 1,\ L \geq 1$$

where "x circumflex" here designates the first and second forecast ("prediction value") and "x tilde" designates the reconstructed value/the current channel values or those preceding in time. If the second term is present, "x circumflex" is allocated, for example, to the second forecast and otherwise to the first forecast.

The double sum in the above formula contributes to the prediction value based only on values from preceding time steps (due to "t−i") (channel values preceding in time), but not mandatorily from the same channel (but from channel k-m, wherein m can also be 0). The fact that the second sum goes to I_m takes into account the fact that in different channels it is possible "to look into the past" to a different extent.

On the basis of the second sum, values from the same time step (current channel values) are also used. In principle, all values from channels which are already calculated can be used for this purpose. In the above formula, the process moves "from bottom to top" in this context. The bottommost channel (channel number 1) is predicted only from values preceding in time. This also follows from the equation above due to setting the (hypothetical) channels with channel numbers <1 to 0. In the next step (for channel number 2) it is now possible to utilize channel number 1, that is to say x tilde(t,1), etc. Naturally, the method is also conceivable in the reverse order of channels and, in principle, even with an arbitrary order of channels. Thus, if the second sum is present, "x circumflex" preferably designates a prognostic value of the second forecast.

For example, the prediction is performed on the basis of values preceding in time (the double sum) in parallel in a number of frequency channels and consequently the first forecast is generated. In this context, the frequency channels can be chosen, for example, to be equidistant, an arbitrary selection also being possible such as, for example, every second frequency channel. This method brings the advantage that the values, which now can be calculated in parallel, can be quantized by vector quantization which generally leads to lesser quantization noise. In a second and subsequent step, the reconstructed values of the same time step, obtained in the preceding step, can now be used for the prediction. In other words, the second forecast is generated. For example, the generation takes place for all odd channel numbers.

The hearing device has a communication facility for transmitting and/or receiving an audio signal. For this purpose, the communication facility contains a transmitter and a receiver, respectively. The communication facility is suitable and provided and configured to perform a method for transmitting an audio signal from the transmitter and to the receiver, respectively. In this context, the method provides that at the transmitter end, an input signal corresponding to the audio signal is divided into a number of frequency channels for a particular time window and that at the transmitter end, a current channel value is allocated to each frequency channel. Furthermore, the current channel values are divided into a first current data record and a second current data record at the transmitter end and, at the transmitter end, a first forecast is generated for the first current data record by means of a channel value preceding in time. In another operating step, a first deviation between the first forecast and the first current data record is determined at the transmitter end and a second forecast is generated for the second current data record by means of the first current data record at the transmitter end. At the transmitter end, a second deviation between the second forecast and the second current data record is determined.

Furthermore, the method provides that a first transmission value corresponding to the first deviation and a second transmission value corresponding to the second deviation are transmitted from the transmitter to the receiver. At the receiver end, a first reconstructed data record is generated by means of a reconstructed output signal preceding in time and the transmitted first transmission value and, at the receiver end, a second reconstructed data record is generated by means of the first reconstructed data record and the transmitted second transmission value. In a further operating step, the first reconstructed data record and the second reconstructed data record are combined to form a reconstructed output signal at the receiver end.

Insofar as the communication facility only contains the transmitter, in particular only the transmitter-end operating steps and an operating step for transmitting the deviations are performed in this context. If the communication facility only contains the receiver, only the receiver-end operating steps and an operating step for receiving the deviations are carried out, in particular. The transmission is suitably carried out wirelessly, for example inductively or by means of radio.

The hearing device preferably contains a sensor by which, in operation, an audio signal is detected. The sensor is preferably an electromechanical sound transducer such as a microphone. For example, the input signal is the audio signal or the input signal is generated by means of the audio signal. For example, the input signal is a part of the audio signal or corresponds to a particular frequency range of the audio signal. To generate the input signal from the audio signal, the hearing device contains, for example, a signal processing unit and/or filter. The hearing device preferably contains an amplifier circuit by which the audio signal can be amplified. The hearing device preferably contains an actuator by which a sound signal is generated, like a loudspeaker, and which is suitable and, for example, provided and suitable for outputting the output signal or the reconstructed output signal, respectively.

For example, the hearing device is a headset or has a headset. Particularly preferably, however, the hearing device is a hearing aid. The hearing aid is used for supporting a person suffering from a reduction of their hearing power. In other words, the hearing aid is a medical device by which, for example, a partial loss of hearing is compensated for. The hearing aid is, for example, a "receiver-in-the-canal" (RIC) hearing aid, an in-ear hearing aid, such as an "in-the-ear" hearing aid, an "in-the-canal" (ITC) hearing aid or a "complete-in-canal" (CIC) hearing aid, hearing aid glasses, a pocket hearing aid, a bone conduction hearing air or an implant. Particularly preferably, the hearing aid is a "behind-the-ear" hearing aid which is worn behind the outer ear.

The hearing aid is provided and configured to be worn on the human body. In other words, the hearing aid preferably contains a holding device by which attachment to the human body is possible. Insofar as the hearing device is a hearing aid, the hearing device is provided and configured to be arranged, for example, behind the ear or inside an auditory canal. In particular, the hearing device is cableless and provided and configured for being inserted at least partially into an auditory canal. For example, the hearing device is a component of a hearing device system which contains a further hearing device or a further device such as a directional microphone or another device having a microphone. In this context, the device preferably contains the transmitter and the hearing device contains the receiver and the audio signal is transmitted between the transmitter and the receiver in accordance with the method.

The hearing device system preferably contains two hearing devices which have in each case a communication facility which is provided and configured for transmitting and/or receiving an audio signal according to the above method. In this context, the hearing device system is suitable and provided and configured to transmit audio signals between the two hearing devices by their respective communication facilities, the above method being carried out. In particular, each of the communication facilities has in each case a transmitter and a receiver and the audio signals are transmitted between the two communication facilities, at least from one of the hearing devices to the remaining one. The transmission is suitably wireless, for example inductive or by means of radio.

Particularly preferably, the hearing device system is a hearing aid system. The hearing aid system is used for supporting a person suffering from reduction of the hearing power. In other words, the hearing aid system is a medical device by which, for example, a partial hearing loss is compensated for. The hearing aid system suitably contains a behind-the-ear hearing aid which is worn behind the outer ear, a "receiver-in-the-canal" (RIC) hearing aid, an in-ear hearing aid, such as an in-the-ear hearing aid, an "in-the-canal" (ITC) hearing aid or a "complete-in-canal" (CIC) hearing aid, hearing aid glasses, a pocket hearing aid, a bone-conduction hearing aid or an implant. The hearing device system is particularly provided and configured to be worn on the human body. In other words, the hearing device system preferably contains a holding device by which an attachment to the human body is provided for. Insofar as the hearing device system is a hearing aid system, at least one of the hearing devices is provided and configured to be arranged, for example, behind the ear or inside the auditory canal. In particular, the hearing device system is cable less and provided and configured to be introduced at least partially into an auditory canal. Particularly preferably, the hearing device system contains an energy store by which an energy supply is provided.

The developments and advantages described in conjunction with the method are analogously also to be transferred to the hearing device or the hearing device system, respectively, and vice versa.

Other features which are considered as characteristic for the invention are set forth in the appended claims.

Although the invention is illustrated and described herein as embodied in a method for transmitting an audio signal from a transmitter to a receiver, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Parts corresponding to one another are provided with the same reference symbols in all figures.

Figure 1:
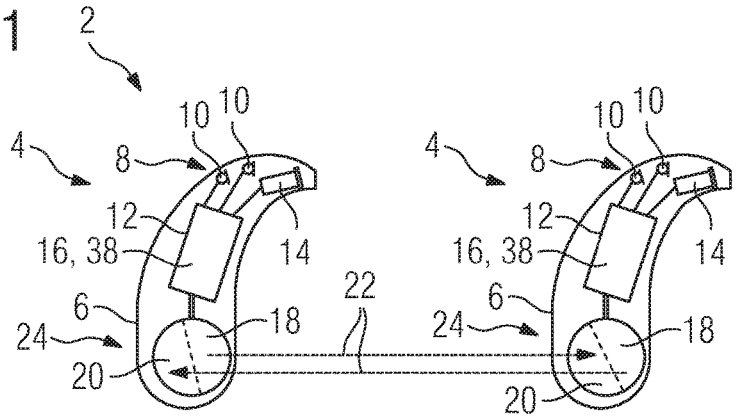
FIG. 1 is an illustration diagrammatically showing a hearing device system having two hearing devices.

Referring now to the figures of the drawings in detail and first, particularly to FIG. 1 thereof, there is shown a hearing device system 2 having two constructionally identical hearing aids 4, which hearing aids 4 are provided and configured to be worn behind the ear of a user. In other words, they are in each case behind-the-ear hearing aids which have an acoustic tube, not shown, which is introduced into the ear. Each hearing aid 4 contains a housing 6 which is made of a plastic material. Inside the housing 6, a microphone 8 having two electromechanical sound transducers 10 is arranged. By the two electromechanical sound transducers 10, it is possible to change a directional characteristic of the microphone 8 by changing an offset in time between the acoustic signals detected by the respective electromechanical sound transducer 10. The two electromechanical sound transducers 10 are coupled to a signal processing unit 12, which contains an amplifier circuit, with respect to signals. The signal processing unit 12 is formed by circuit elements such as, for example, electrical and/or electronic components.

Furthermore, a loudspeaker 14 is coupled to the signal processing unit 12 with respect to signals, by which loudspeaker audio signal 16 recorded by the microphones 8 and/or processed by the signal processing unit 12 are output as sound signals. These sound signals are conducted into the ear of a user of the hearing device system 2 by an acoustic tube not shown in detail.

Each of the hearing aids 4 also has a transmitter 18 and a receiver 20 by which an exchange of data signals 22 takes place between the two hearing aids 4. The exchange takes place, for example, by radio or inductively. Here, the signal processing unit 12, the transmitter 18 and the receiver 20 together form in each case essentially a communication facility 24. Due to the exchange of data signals 22 it is made possible to convey a spatial hearing sensation to the wearer of the hearing device system 2. In summary, the hearing device system 2 is equipped binaurally.

Figure 2:
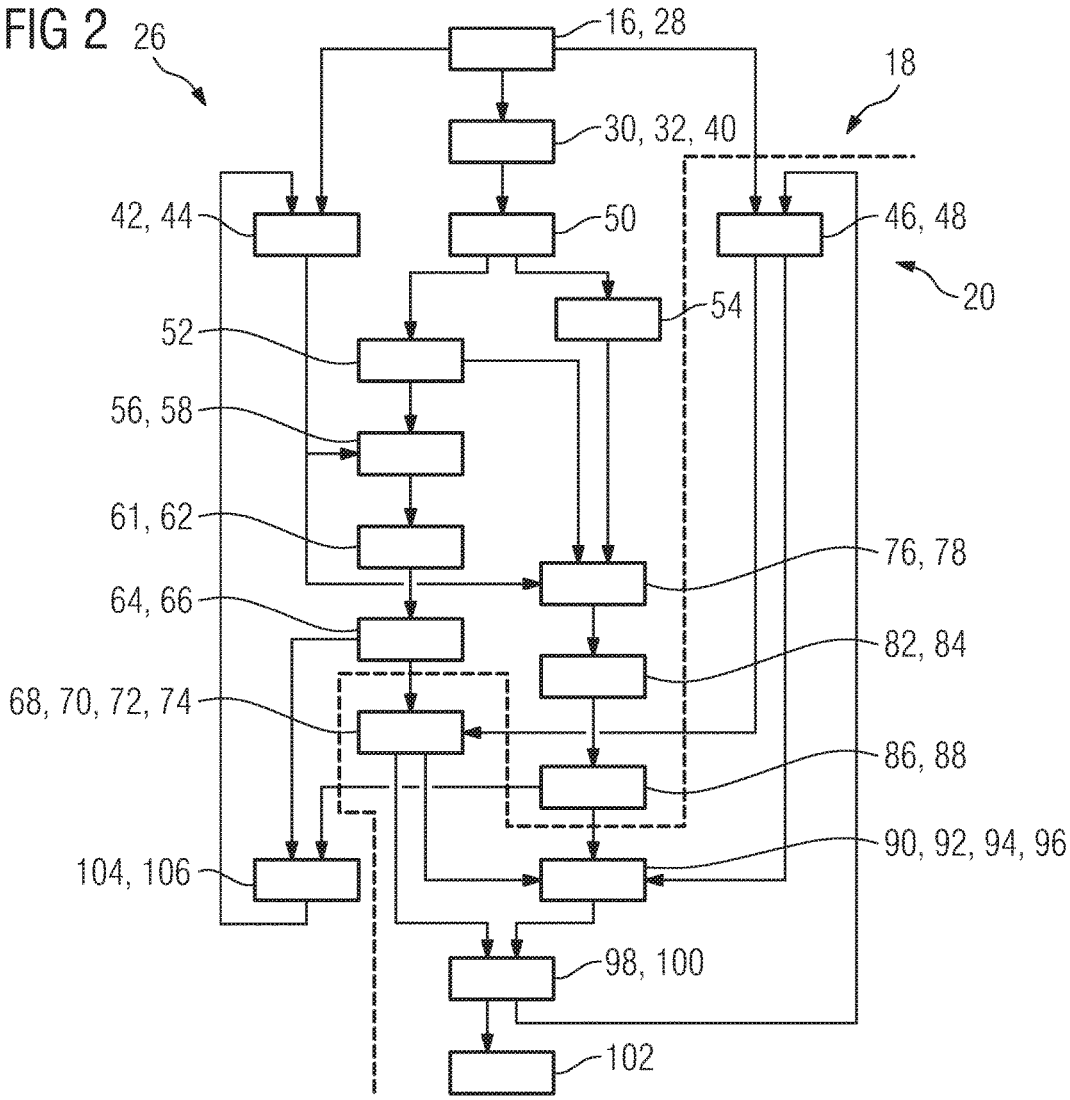
FIG. 2 is a flow chart showing a method for transmitting an audio signal between the two hearing devices.
Figure 3:
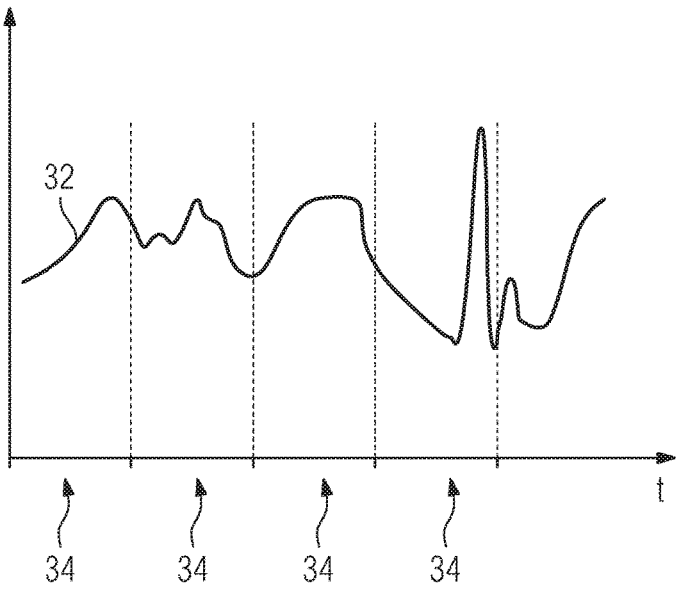
FIG. 3 is a graph showing an input signal corresponding to the audio signal.
Figure 4:
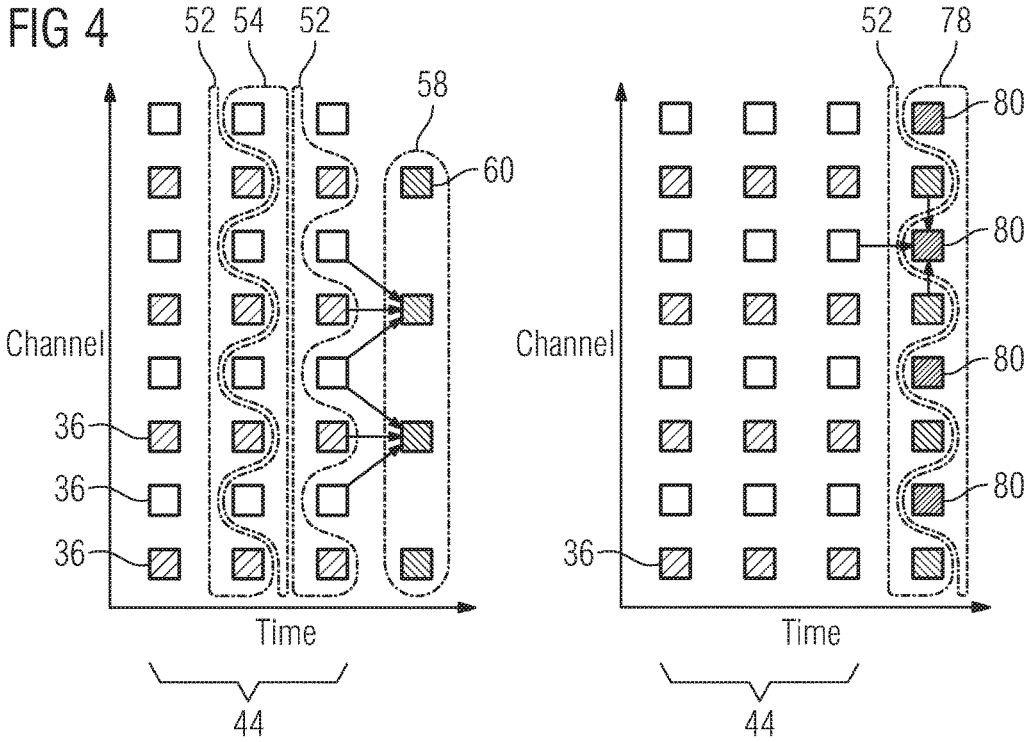
FIGS. 4-6 are illustrations which in each case show data records partially.

In FIG. 2, a method 26 is shown according to which the audio signals 16 are transmitted between the two hearing devices 4 by their respective communication facility 24. In a first operating step 28, the audio signal 16 is received by the hearing aid 4. In a subsequent second operating step 30, an input signal 32 is generated from this which in consequence corresponds to the audio signal 16 and which is shown by way of example in FIG. 3. For this purpose, the audio signal 16 is filtered, for example. Furthermore, the input signal 32 is subdivided into time windows 34 which have the same length in time which, for example, is equal to one millisecond. As soon as the last time window 34 in time is ended, this time window 34 is divided into a number of frequency channels 36 as shown, for example, in FIG. 4. To divide the input signal 32 into the individual frequency channels 36, bandpass filters (frequency pass filters) 38 are utilized which are present within the signal processing unit 16. To each of the frequency channels 36, a particular current channel value 40 is allocated. In summary, the input signal 32 is divided into the individual frequency channels 36 in the second operating step 30, and discretized by means of the allocation of the current channel value 40.

Furthermore, after the first operating step 16 is carried out by the transmitter 18, a third operating step 42 is carried out in which channel values 44 preceding in time are filled. These have been determined, for example, during a preceding pass of the method 26 or, if the method 26 has not yet been carried out, a standard value is utilized for this purpose. As well, a fourth operating step 46 is carried out at the receiver 20 in which a reconstructed audio signal 48 preceding in time is determined. This corresponds to the channel values 44 preceding in time and is determined in the same way as the channel values 44 preceding in time.

Furthermore, a fifth operating step 50 is carried out in which the number of current channel values 40 is divided into a first current data record 52 and a second current data record 54. In this context, the current channel values 40, which are allocated to an odd frequency channel 36, are allocated to the first data record 52 and the remaining current channel values 40 are allocated to the second current data record 54 so that the two current data records 52, 54 have essentially the same number of current channel values 40.

In a sixth operating step 56, a first forecast 58 is generated for the first current data record 52 by use of the channel values 44 preceding in time. To generate the first forecast 58, a linear prediction is utilized. In other words, a number of prognostic values 60 is generated, each of the prognostic values 60 being allocated to one of the current channel values 40 of the first current data record 52. For example, only the channel values 44 preceding in time, which are allocated to the time window 34 directly preceding in time, are utilized. In this context, for example, only the channel values 44 preceding in time, which are allocated to adjacent frequency channels 36, are used for generating the respective prognostic value 60 ("predicted value").

In a subsequent seventh operating step 61, a first deviation 60 between the first forecast 58 and the first current data record 52 is generated for which the difference between each of the current channel values 40 of the first current data record 52 and each of the prognostic values 60 of the first forecast 62 is subtracted for generating a difference value. The number of prognostic values 60 and the number of difference values correspond to the number of current channel values 40 of the first current data record 52.

In a subsequent eighth operating step 64, a first transmission value 66 which corresponds to the first deviation 62 is generated by a spherically logarithmic quantization. The first transmission value 66 is in this case unidimensional. In other words, the unidimensional first transmission value 66 is allocated to the multidimensional first deviation 62. This value is transmitted by one of the data signals 22 to the receiver 20 of the remaining hearing aid 4. By means of the communication facility 24 of the hearing aid 4 having the receiver 20, a ninth operating step 68 is carried out which, by means of carrying out the inverse function corresponding to quantization, a first auxiliary data record 70 is generated which, in consequence, corresponds to the first deviation 62. By utilizing the reconstructed output signal 48 preceding in time, a first auxiliary forecast 72 also is generated likewise with prognostic values, using the same linear prediction as for the generation of the first forecast 58. Since the reconstructed output signal 48 preceding in time corresponds to the channel values 44 preceding in time, the first auxiliary forecast 72 corresponds to the first forecast 58. Furthermore, the first auxiliary data record 70 is added value by value to the first auxiliary forecast 72. The resultant data record is a first reconstructed data record 74 which, with the exception of any noise/disturbances induced due to the use of the spherically logarithmic quantization, corresponds to the first data record 52 which is present at the transmitter 18.

At the transmitter 18, a second forecast 78 is generated with a number of prognostic values 80 ("predicted value") corresponding to the number of current channel values 44 of the second current data record 54 on the basis of the channel values 44 preceding in time and by using the current channel values 40 of the first current data record 52 by a linear prediction in a tenth operating step 76, wherein, for example, the channel values 44 of adjacent frequency channels 36 of the first current data record 52 and the respective value, preceding in time, of the same frequency band 36 are utilized for generating the prognostic value 80. In consequence, the second forecast 78 is generated by the channel values 44 preceding in time and the first current data record 52. In this context, each of the prognostic values 80 corresponds to one of the current channel values 44 of the second current data record 54. In a subsequent eleventh operating step 82, a second deviation 84 between the second forecast 78 and the second current data record 54 is determined by generating the difference between each current channel value 40 of the second current data record 54 and the respective allocated prognostic value 80 of the second forecast 78 for forming a difference value. The number of the difference values forms in this context the second deviation 84.

In a subsequent twelfth operating step 86, a second transmission value 88 which, in consequence, corresponds to the second deviation 84, is generated on the basis of the second deviation 84 by means of spherically logarithmic quantization. The second transmission value 86 is in this context also unidimensional and, for example, essentially the same spherical logarithmic quantization is utilized which is also used for generating the first transmission value 66. The second transmission value 88 is transmitted from the transmitter 18 by the data signals 22 to the receiver 20 of the hearing aid 4 to which the first transmission value 66 has also been transmitted.

By means of its communication facility 24, a second reconstructed data record 92 is generated in a thirteenth operating step 90. In this context, a second auxiliary data record 94 is generated by the second transmission value 88, a function inverse to the spherically logarithmic quantization being carried out. In consequence, the second auxiliary data record 94, with the exception of any noise which has been introduced due to the quantization, corresponds to the second deviation 84. Furthermore, a second auxiliary forecast 96 is generated in the thirteenth operating step 90 by the first reconstructed data record 74 and by the reconstructed output signal 48 preceding in time and the first reconstructed data record 74, for which purpose a linear prediction is utilized. In this context, the same coefficients are used as for generating the second forecast 78. Due to the essentially equal values used for generating the forecast, the second auxiliary forecast 96, therefore, corresponds essentially to the second forecast 78. For generating the second reconstructed data record 92, the second auxiliary data record 94 is added value by value to the second auxiliary forecast 96. In summary, the second reconstructed data record 92 is generated at the receiver end by the reconstructed output signals 48 preceding in time and the first reconstructed data record 74.

In a subsequent fourteenth operating step 98, the first reconstructed data record 74 and the second reconstructed data record 92 are combined to form a reconstructed output signal 100 which, in consequence, essentially has the current channel values 40. Any difference exists in this context only due to any quantization effects. The output signal 100 is used as reconstructed output signal 48 preceding in time for repeated execution of the method 26 or at least added to the reconstructed output signal. In a subsequent fifteenth operating step 102, the reconstructed output signal 100 is transformed from the frequency domain into the time domain and, for example, output by the loudspeaker 14.

Furthermore, a sixteenth operating step 104 is carried out at the transmitter 18 in which, by the first and second transmission values 66, 88 and by utilizing the first and second forecasts 58, 78, a third reconstructed data record 106 is generated. In this context, the ninth operating step 68 and the thirteenth operating step 90 are carried out essentially at the transmitter 18, using the first forecast 58 instead of the first auxiliary forecast 72 and the second forecast 78 instead of the second auxiliary forecast 96. As well, the two reconstructed data records are added in order to form the third reconstructed data record 106. In consequence, the third reconstructed data record 106 corresponds to the output signal 100. In other words, the third reconstructed data record 106 also has some interfering noises due to the quantization used. With a repeated execution of the method 26, the third reconstructed data record 106 is utilized as channel values 44 preceding in time so that both at the transmitter 18 and at the receiver 20, the same input data are in each case used for generating the respective forecasts 58, 72, 78, 96.

Figure 5:
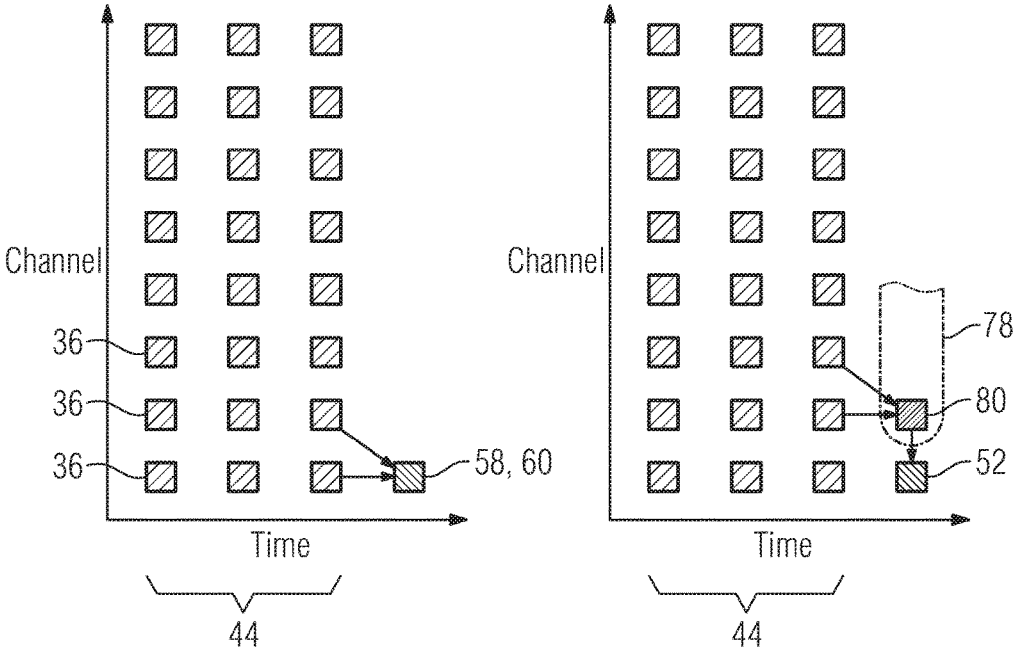

In FIG. 5, a further embodiment of the generation of the first forecast 58 and the generation of the second forecast 78 and, in consequence, also the generation of the two reconstructed data records 74, 92 is shown. In this context, the first current data record 54 only has a single one of the current channel values 44 and, in consequence, the first forecast 58 only contains a single prognostic value 60. By means of the current channel value 40 allocated to this single prognostic value 60, one of the prognostic values 80 of the second forecast 78 is generated and is allocated to the directly adjacent frequency channel 36. The current channel value 40 allocated to this prognostic value 80 is, in turn, utilized in a further operating step for determining a further prognostic value 80 which is allocated to just this value in the directly adjacent frequency channel 36, etc. Alternatively, all prognostic values 80 are generated by the single current channel value 40 of the first current data record 54.

Figure 6:
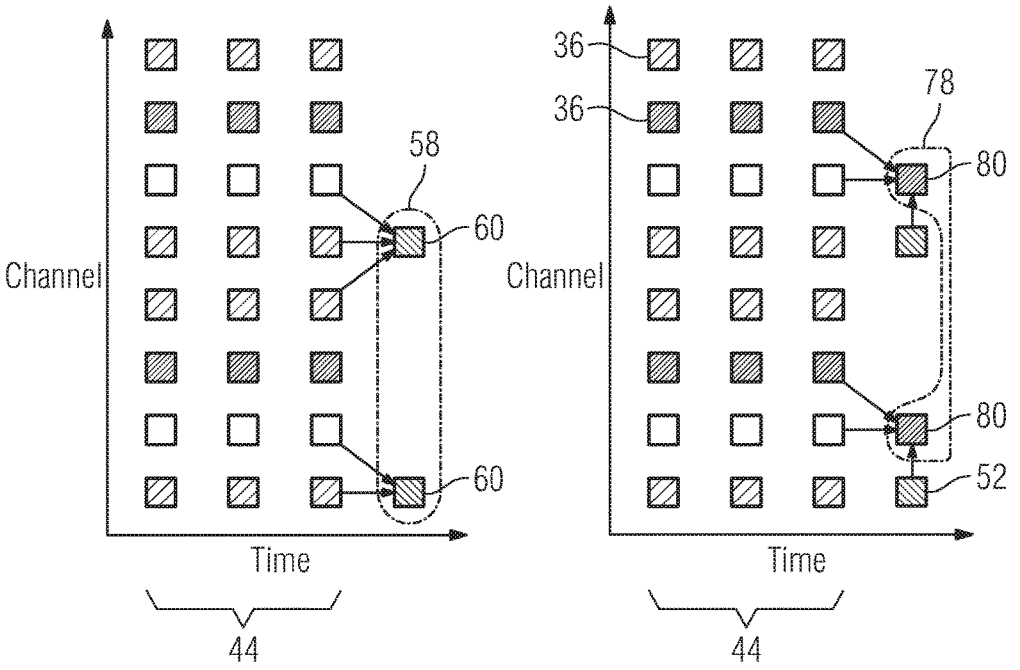

In FIG. 6, a further embodiment is shown. In this context, the first data record 52 essentially exhibits one fifth of all current channel values 40, these, for example, being allocated to frequency channels 36 which are spaced apart with respect to one another by means of in each case four of the frequency channels 36. To determine the prognostic values 80 of the second forecast 78 and, in consequence, also the second auxiliary forecast 96, these are utilized, the number of prognostic values 80 corresponding to the number of prognostic values 60. Subsequently to this, further prognostic values 80 which are allocated to the directly adjacent frequency band 36 are determined by means of the current channel values 40 allocated to these prognostic values 80 of the second forecast 78. For example, the current channel values 40 are distributed over a number of data records and a number of deviations is determined and a respective transmission value corresponding thereto is transmitted. In other words, the method 26 presented in FIG. 2 is carried out essentially in cascaded manner.

In summary, due to the use of values already reconstructed or actual values for generating the second forecast 78 and for generating the second auxiliary forecast 96, respectively, any correlation between the frequency channels 36 is taken into consideration so that the second deviation 84 is comparatively small.

The invention is not restricted to the exemplary embodiments described above. Instead, other variants of the invention can also be derived from said exemplary embodiments by the expert without departing from the subject matter of the invention. In particular, all individual features described in conjunction with the individual exemplary embodiments can also be combined with one another in a different way without departing from the subject matter of the invention.

The following is a summary list of reference numerals and the corresponding structure used in the above description of the invention:

2 Hearing device system
4 Hearing aid
6 Housing
8 Microphone
10 Sound transducer
12 Signal processing unit
14 Loudspeaker
16 Audio signal
18 Transmitter
20 Receiver
22 Data signal
24 Communication facility
26 Method
28 First operating step
30 Second operating step
32 Input signal
34 Time window
36 Frequency channel
38 Bandpass filter
40 Current channel value
42 Third operating step
44 Channel value preceding in time
46 Fourth operating step
48 Reconstructed output signal preceding in time
50 Fifth operating step
52 First current data record
54 Second current data record
56 Sixth operating step
58 First forecast
60 Prognostic value
61 Seventh operating step
62 First deviation
64 Eighth operating step
66 First transmission value
68 Ninth operating step
70 First auxiliary data record
72 First auxiliary forecast
74 First reconstructed data record
76 Tenth operating step
78 Second forecast
80 Prognostic value
82 Eleventh operating step
84 Second deviation
86 Twelfth operating step
88 Second transmission value
90 Thirteenth operating step
92 Second reconstructed data record
94 Second auxiliary data record
96 Second auxiliary forecast
98 Fourteenth operating step
100 Reconstructed output signal
102 Fifteenth operating step
104 Sixteenth operating step
106 Third reconstructed data record

The invention claimed is:

1. A method for transmitting an audio signal from a transmitter to a receiver, which comprises the steps of:

dividing an input signal corresponding to the audio signal into a number of frequency channels for a particular time window, at a transmitter end;

allocating a current channel value to each frequency channel at the transmitter end;

dividing current channel values into a first current data record and a second current data record, at the transmitter end;

generating a first forecast for the first current data record by means of a channel value preceding in time at the transmitter end;

determining a first deviation between the first forecast and the first current data record at the transmitter end;

generating a second forecast for the second current data record by means of the first current data record and by means of the channel value preceding in time, at the transmitter end;

determining a second deviation between the second forecast and the second current data record at the transmitter end;

transmitting a first transmission value corresponding to the first deviation from the transmitter to the receiver;

transmitting a second transmission value corresponding to the second deviation from the transmitter to the receiver;

generating a first reconstructed data record by means of a reconstructed output signal preceding in time and the first transmission value, at a receiver end;

generating a second reconstructed data record by means of the first reconstructed data record, the reconstructed output signal preceding in time, and the second transmission value at the receiver end; and combining the first reconstructed data record and the second reconstructed data record to form a reconstructed output signal at the receiver end.

2. A method for transmitting an audio signal from a transmitter to a receiver, which comprises the steps of:

dividing an input signal corresponding to the audio signal into a number of frequency channels for a particular time window, at a transmitter end;

allocating a current channel value to each frequency channel at the transmitter end;

dividing current channel values into a first current data record and a second current data record, at the transmitter end;

generating a first forecast for the first current data record by means of a channel value preceding in time at the transmitter end;

determining a first deviation between the first forecast and the first current data record at the transmitter end;

generating a second forecast for the second current data record by means of the first current data record, at the transmitter end;

determining a second deviation between the second forecast and the second current data record at the transmitter end;

transmitting a first transmission value corresponding to the first deviation from the transmitter to the receiver;

transmitting a second transmission value corresponding to the second deviation from the transmitter to the receiver;

generating a first reconstructed data record by means of a reconstructed output signal preceding in time and the first transmission value, at a receiver end;

generating a second reconstructed data record by means of the first reconstructed data record and the second transmission value at the receiver end;

utilizing a linear prediction for generating the first forecast and the first reconstructed data record and/or for generating the second forecast and the second reconstructed data record; and combining the first reconstructed data record and the second reconstructed data record to form a reconstructed output signal at the receiver end.

3. The method according to claim 1, which further comprises dividing the input signal into the frequency channels by means of band pass filters.

4. A method for transmitting an audio signal from a transmitter to a receiver, which comprises the steps of:

dividing an input signal corresponding to the audio signal into a number of frequency channels for a particular time window, at a transmitter end;

allocating a current channel value to each frequency channel at the transmitter end;

dividing current channel values into a first current data record and a second current data record, at the transmitter end;

generating a first forecast for the first current data record by means of a channel value preceding in time at the transmitter end;

determining a first deviation between the first forecast and the first current data record at the transmitter end;

generating a second forecast for the second current data record by means of the first current data record, at the transmitter end;

determining a second deviation between the second forecast and the second current data record at the transmitter end;

generating a first transmission value by means of quantization of the first deviation and generating a second transmission value by means of quantization of the second deviation;

transmitting the first transmission value from the transmitter to the receiver;

transmitting the second transmission value from the transmitter to the receiver;

generating a first reconstructed data record by means of a reconstructed output signal preceding in time and the first transmission value, at a receiver end;

generating a second reconstructed data record by means of the first reconstructed data record and the second transmission value at the receiver end; and combining the first reconstructed data record and the second reconstructed data record to form a reconstructed output signal at the receiver end.

5. The method according to claim 4, wherein at the transmitter end, by means of the first and second transmission values, respectively, and the first forecast and the second forecast, respectively, a third reconstructed data record is generated which is utilized as the channel value preceding in time during a transmission following in time.

6. The method according to claim 4, which further comprises utilizing a vector quantization for the quantization.

7. The method according to claim 4, which further comprises utilizing a spherical logarithmic quantization for the quantization.

8. The method according to claim 1, which further comprises generating the first reconstructed data record by the further steps of:

generating, by means of the first transmission value, a first auxiliary data record which corresponds to the first deviation;

generating, by means of the reconstructed output signal preceding in time, a first auxiliary forecast which corresponds to the first forecast; and adding the first auxiliary data record to the first auxiliary forecast.

9. The method according to claim 1, wherein the second reconstructed data record is generated by the further steps of:

generating, by means of the second transmission value, a second auxiliary data record which corresponds to the second deviation;

generating, by means of the first reconstructed data record, a second auxiliary forecast which corresponds to the second forecast; and adding the second auxiliary data record to the second auxiliary forecast.

10. The method according to claim 1, wherein the first and/or second deviation is generated in that a difference between each said current channel value of the first current data record and of the second current data record, respectively, and an allocated prognostic value of the first and second forecast is generated for forming a difference value and difference values form the first and second deviation, respectively.

11. The method according to claim 1, which further comprises dividing the current channel values in halves between the first current data record and the second current data record.

12. A hearing device, comprising:

a communication facility provided and configured for transmitting and/or receiving an audio signal according to a method according to claim 1.

13. A hearing device system, comprising two hearing devices each having a communication facility provided and configured for transmitting and/or receiving an audio signal according to a method according to claim 1, said hearing devices configured to transmit audio signals between said two hearing devices by means of said communication facility.

* * * * *